US005178520A

United States Patent [19]

Strelow

[11] Patent Number: 5,178,520

[45] Date of Patent: Jan. 12, 1993

[54] DOUBLE CENTRIFUGAL PUMP WITH SINGLE CASING AND ADAPTER INSERT

[75] Inventor: Günter Strelow, Bochum, Fed. Rep. of Germany

[73] Assignee: Wilo-Werk GmbH & Co. Pumpen- und Apparatebau, Dortmund, Fed. Rep. of Germany

[21] Appl. No.: 718,552

[22] Filed: Jun. 20, 1991

[30] Foreign Application Priority Data

Jul. 6, 1990 [DE] Fed. Rep. of Germany ..... 4021410

[51] Int. Cl.[5] ..... F04B 23/04

[52] U.S. Cl. ..... 417/62; 417/238; 417/427; 417/423.5; 415/60; 415/148; 415/182.1; 415/912

[58] Field of Search ..... 415/60, 148, 182.1, 415/203, 912; 417/62, 238, 426, 427, 423.5

[56] References Cited

U.S. PATENT DOCUMENTS

| | | | |
|---|---|---|---|
| 2,810,345 | 10/1957 | Englesson | 417/426 |
| 4,178,131 | 12/1979 | Sieghartner | 415/912 |
| 4,738,584 | 4/1988 | Price | 415/60 |
| 5,020,420 | 6/1991 | Ellis | 417/238 |
| 5,076,758 | 12/1991 | Palgrave | 415/912 |

FOREIGN PATENT DOCUMENTS

| | | | |
|---|---|---|---|
| 3624917 | 3/1987 | Fed. Rep. of Germany . | |
| 0558885 | 2/1975 | Switzerland | 417/427 |

*Primary Examiner*—Edward K. Look
*Assistant Examiner*—Christopher M. Verdier
*Attorney, Agent, or Firm*—Herbert Dubno

[57] ABSTRACT

A centrifugal or rotary double pump has a singular circular casing surmounting two motors driving individual rotors within the casing. Above a flat side of the casing is attachable to the device serviced by the double pump and receives an insert defining the inlet and outlet apertures and within the housing, defining two pump units each in conjunction with the respective rotor.

6 Claims, 2 Drawing Sheets

PARALLEL CONNECTION

SERIES CONNECTION

TWO CIRCUITS
e.g. IN BOILER RETURN

TWO CIRCUITS
e.g. IN BOILER FEED

TWO SEPARATE PUMPS

REVERSE DELIVERY

DOUBLE CENTRIFUGAL PUMP WITH SINGLE CASING AND ADAPTER INSERT

FIELD OF THE INVENTION

My present invention relates to a double centrifugal pump having two pump rotors mounted in a casing and two electric motors disposed in parallel, one beside the other.

BACKGROUND OF THE INVENTION

Double pumps are known which are used for parallel, serial and separate operation, with the possibility of changing the delivery direction and also with a switch-over function. An independent construction must be provided for each of these applications.

Moreover, German OS 3624917 discloses how to dispose in the casing of a centrifugal pump an insert which forms the inlet and the outlet and also the spirally widening outlet channel.

OBJECT OF THE INVENTION

It is an object of the invention to provide a double centrifugal pump which has a very simple and small construction and can be used for the various applications with only slight alterations, while retaining the pump casing.

SUMMARY OF THE INVENTION

This object is achieved, according to the invention, by a pump which has the following combination of features:

the pump casing has a flat side wall containing an inlet and an outlet, the pump casing is attached via this flat side wall to a second device, more particularly, a consuming device, disposed releasably in the pump casing is an insert which can be inserted through a large aperture in the flat side wall and forms an inlet and an outlet and also internal connecting channels, and disposed in the insert are one or more cut-off members, more particularly, flap valves or non-return valves.

In such a pump only the insert must be adapted to the various applications, since the insert contains in the necessary manner of construction and connection both the connecting channels and also the particular cut-off member required, for example, a flap valve or the non-return valve. The insert can readily be reached and interchanged via the aperture in the flat side wall, while the dimensions of the connecting flange of the pump casing remain the same.

Particularly advantageously the insert forms a spirally widening outlet channel for each rotor. The insert should also form at least a portion of the flat side wall. Particularly advantageously the insert forms the connection surfaces for the inlet and outlet. The insert can be produced particularly cheaply if it is made of plastic. It is a major advantage if the aperture in the flat side wall for the insert is circular and merges into a cylindrical inner space of the pump casing.

BRIEF DESCRIPTION OF THE DRAWING

A more detailed description will now be given of an embodiment of the invention with reference to the drawing, wherein.

SPECIFIC DESCRIPTION

Figure 2:
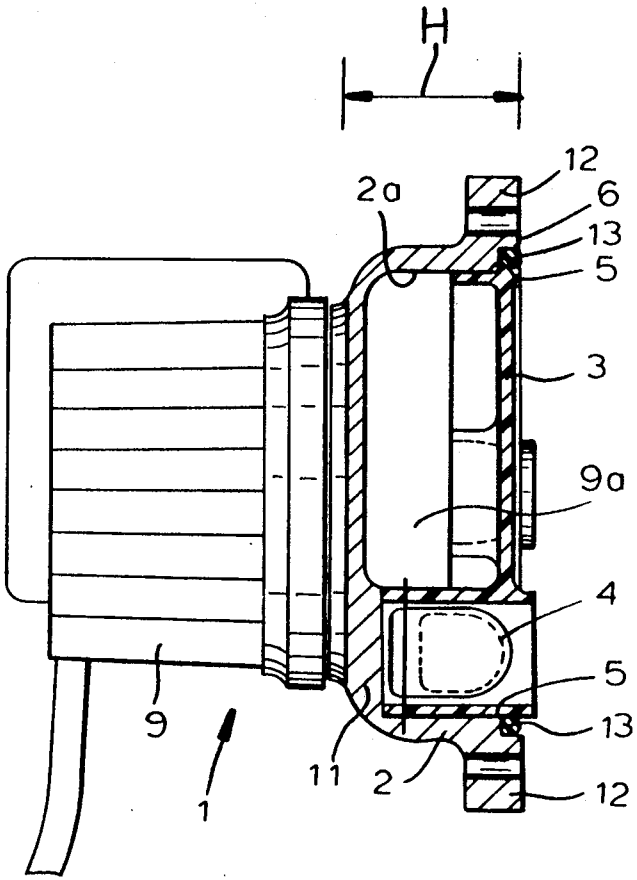
FIG. 2 is an axial section through the pump, the motor not being shown in section.
Figure 1:
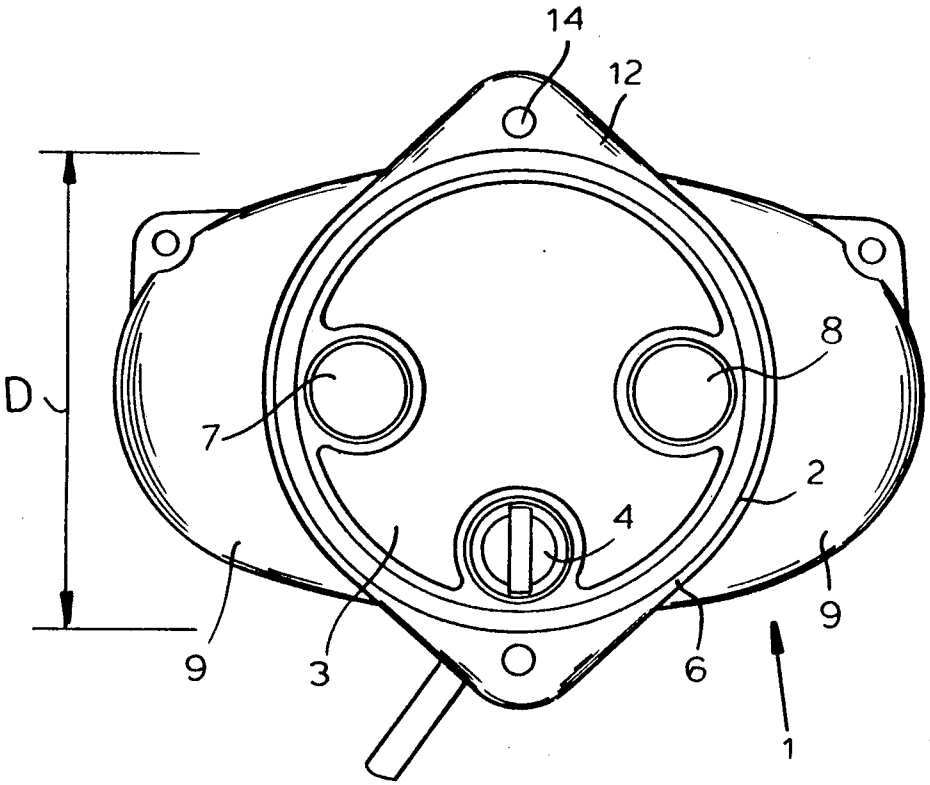
FIG. 1 is a side elevation of the flat side wall of the pump.

A double pump has two canned pumps and can be used as a hot water pump, more particularly in heating installations. The pump 1 has a plastic or metal pump casing 2 in which two rotors 9*a* are disposed axis-parallel and in which a tubular inlet is formed axially. A spirally widening outlet channel is disposed around each of the rotors. The casing 2 is circular disc-shaped, the height H of the cylindrical outer wall being substantially smaller than the diameter D of the flat circular pump side wall 6.

Inlets 7 and 8 form inlet apertures and outlet 4 with an outlet aperture open at the side wall 6. The apertures are located in the plane of the side wall 6. Two canned electric motors 9 are attached coaxially with the rotors 9*a* to the side of the pump casing 2 opposite the side wall 6.

The pump casing 2 has an inner insert 3 which tightly encloses the rotors and forms the spirally widening outlet channels around the rotors, and an outer casing 11 which encloses the insert 3 and which is attached to the electric motors 9 and bears seals 13 lying in the plane of the side wall 6. The insert 3 therefore cooperates with the casing edge to form the flat interface with the consumption or connection devices. Particularly advantageously the aperture 5 in the flat side wall 6 for the insert 3 is circular and merges into a cylindrical inner space 2*a* of the pump casing.

The outer casing 11, acting as a pressure tank, forms parallel with the side wall 6 flanges 12 formed with bores 14 which can receive screws. Via these screws (not shown) the outer casing 11 and therefore the entire pump can be attached to consumption devices. Rotors and inserts 3 of different performances and constructions can be inserted into the outer casing 11.

For this purpose not only can the rotors be replaced by differently shaped rotors, but spiral channels enclosing the rotors and also the inlet can be adapted to both the particular rotors and the required performance and also to the particular range of speed. Furthermore, the inlets 7, 8 and outlet 4, in the insert 3 can be adapted in their spacing and also in their arrangement in the flat side wall 6 to the circumstances of the consumption or connection devices. It is enough to interchange the insert 3 to meet the requirements made.

The channels in the insert 3 can be differently shaped and arranged. Cut-off members 4, for example, flap valves or non-return valves can be so attached or mounted as to suit the particular purpose of use.

Figure 3A:
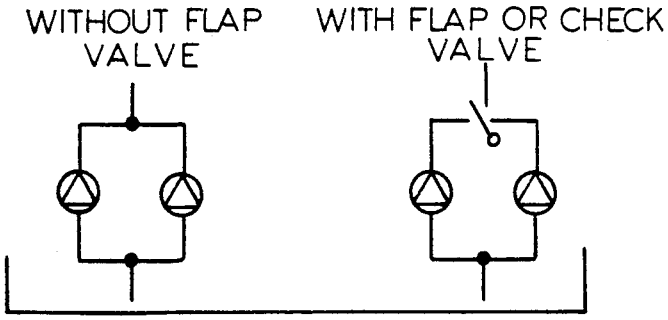
FIGS. 3A–3F show various applications of the pump according to the invention.
Figure 3B:
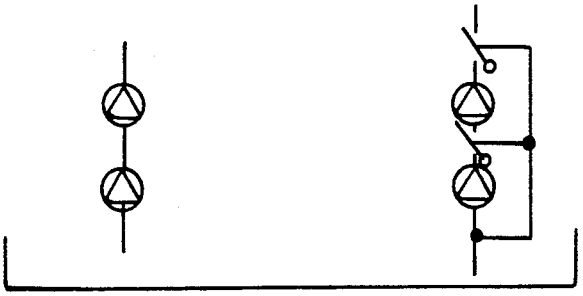
Figure 3C:
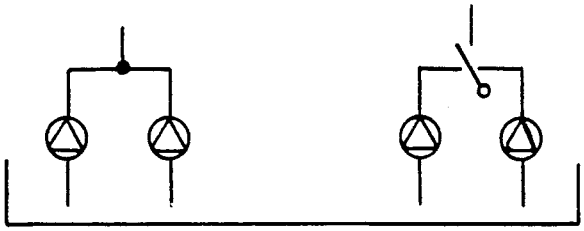
Figure 3D:
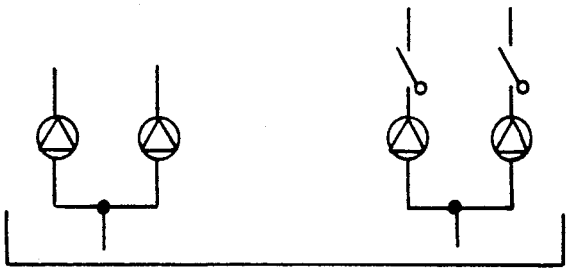
Figure 3E:
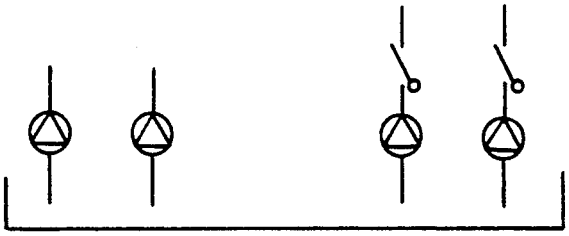
Figure 3F:
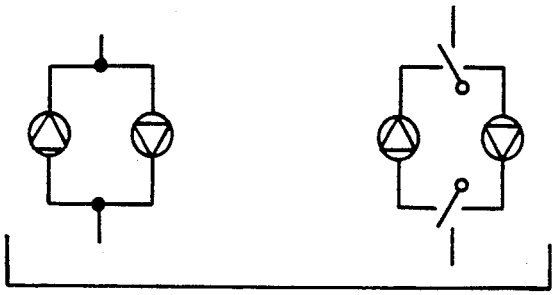

The inner insert 3 can be constructed smaller than shown in the drawings. It may be enough for the insert to form merely the inlet aperture 7 and the control apparatus for the rotor. The insert 3 can also be made up of a number of parts, being particularly simple to produce if it is made of plastic. This makes it possible and economic to supply differently formed inserts with the pump, so that the user can alter the function or output of the pump prior to the incorporation of the insert. The pump units can be connected in the modes shown in FIGS. 3A–3F.

I claim:

1. A double centrifugal pump, comprising:

two electric motors disposed in parallel beside one another;

a single pump casing attached to said motors and formed with:

a flat side wall opposite said motors and provided with a large opening, and means on the casing for securing said casing to a device serviced by said pump at said flat side wall, two pump rotors in said single casing, each connected to one of said motors;

an insert received in and closing said opening and subdividing said casing into two individual pump units each receiving one of said rotors, said insert being formed with inlet and outlet apertures for said units; and at least one valve member received in said insert.

2. The double centrifugal pump defined in claim 1 wherein said casing is generally circular and said side wall is generally circular, said means on the casing for securing said casing including flanges projecting outwardly along said side wall, said insert being circular.

3. The double centrifugal pump defined in claim 2 wherein said valve member is a flap valve.

4. The double centrifugal pump defined in claim 2 wherein said valve member is a nonreturn valve.

5. The double centrifugal pump defined in claim 2 wherein said insert is substantially flush with said flat side wall.

6. The double centrifugal pump defined in claim 2 wherein said insert is composed of plastic.

* * * * *